US008305209B2

(12) United States Patent
Morita et al.

(10) Patent No.: US 8,305,209 B2
(45) Date of Patent: Nov. 6, 2012

(54) ALARM DEVICE

(75) Inventors: Hidesato Morita, Tokyo (JP); Makoto Masuyama, Tokyo (JP); Toshimitsu Watanabe, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 392 days.

(21) Appl. No.: 12/629,292

(22) Filed: Dec. 2, 2009

(65) Prior Publication Data

US 2010/0141436 A1 Jun. 10, 2010

(30) Foreign Application Priority Data

Dec. 5, 2008 (JP) ..... 2008-310464

(51) Int. Cl.
*G08B 1/00* (2006.01)

(52) U.S. Cl. ..... 340/539.22; 340/539.1

(58) Field of Classification Search ..... 340/539.1, 340/539.22

See application file for complete search history.

(56) References Cited

U.S. PATENT DOCUMENTS

| | | | | |
|---|---|---|---|---|
| 4,531,114 | A * | 7/1985 | Topol et al. | 340/539.1 |
| 6,028,513 | A * | 2/2000 | Addy | 340/539.16 |
| 6,144,310 | A * | 11/2000 | Morris | 340/692 |
| 6,614,347 | B2 * | 9/2003 | Tanguay | 340/508 |
| 2011/0018705 | A1 * | 1/2011 | Egawa et al. | 340/539.1 |

* cited by examiner

*Primary Examiner* — Travis Hunnings
(74) *Attorney, Agent, or Firm* — Wenderoth, Lind & Ponack, L.L.P.

(57) ABSTRACT

Provided is an alarm device capable of performing transmission and reception reliably while suppressing an amount of current consumption. An alarm device (100) includes: a fire detection circuit (7); a control circuit (1); and a transmitting/receiving circuit (5). The transmitting/receiving circuit (5) transmits the status signal to the another alarm device (100) with a transmission pattern formed by combining transmission periods and transmission suspension periods a predetermined number of times, and receives the status signal transmitted by the another alarm device (100) in an intermittent reception cycle. A time length of each of the transmission periods and the transmission suspension periods is set so that the another alarm device (100) that has failed to receive the status signal transmitted in a first intermittent reception cycle can receive the status signal in a second intermittent reception cycle and subsequent intermittent reception cycles.

2 Claims, 10 Drawing Sheets

Ts : RECEPTION SAMPLING INTERVAL

Tx(1)、Tx(2)、Tx(3) : TRANSMISSION PERIOD

ST(1)、ST(2) : TRANSMISSION SUSPENSION PERIOD (A)

AMOUNT OF CURRENT CONSUMPTION PER UNIT TIME REQUIRED FOR RECEPTION SAMPLING (B)

AMOUNT OF CURRENT CONSUMPTION REQUIRED FOR TRANSMISSION PROCESSING (C)

TOTAL AMOUNT OF CURRENT CONSUMPTION

Ts : RECEPTION SAMPLING INTERVAL

Tx(1)、Tx(2) : TRANSMISSION PERIOD

ST(1)、ST(2) : TRANSMISSION SUSPENSION PERIOD

Ts : RECEPTION SAMPLING INTERVAL

Tx(1)、Tx(2)、Tx(3)、Tx(4) : TRANSMISSION PERIOD

ST(1)、ST(2)、ST(3)、ST(4) : TRANSMISSION SUSPENSION PERIOD

ALARM DEVICE

BACKGROUND OF THE INVENTION

1. Field of the Invention

The present invention relates to an alarm device capable of performing transmission and reception of a status signal or the like among a plurality of devices.

2. Description of the Related Art

There is provided an alarm device for detecting heat or smoke that is generated in a room or the like and issuing an alarm. Each of such alarm devices performs an alarm operation independently, and also, in some cases, a plurality of alarm devices provided in respective rooms perform the alarm operation in synchronization with one another.

With regard to a transmission system in which the plurality of alarm devices perform the alarm operation in synchronization with one another, there is proposed "a radio transmission system including a plurality of wireless devices, for transmitting a radio signal among the plurality of wireless devices, in which: each of the wireless devices commonly includes at least one of transmission means for transmitting the radio signal and reception means for receiving the radio signal, and a battery for power supply; the wireless device including the transmission means further includes transmission control means for activating the transmission means when a predetermined event has occurred to alternately repeat operations of transmitting the radio signal in a predetermined transmitting period and pausing the transmitting of the radio signal in a predetermined pause period, and for deactivating the transmission means when the predetermined event has not occurred; the wireless device including the reception means further includes timer means for repeatedly counting a constant intermittent receiving interval, and reception control means for deactivating the reception means while the timer means is counting the intermittent receiving interval, and for activating the reception means every time the counting of the intermittent receiving interval by the timer means is finished; and values a and b satisfy $a+2b<T$ and $2a+b>T$ under a condition of $T>a$, where a denotes the transmitting period, b denotes the pause period, and T denotes the intermittent receiving interval" (for example, see JP 2008-176515 A (p. 4, FIG. 1)).

In a conventional transmission system, a transmission side device transmits a status signal or the like in a given constant transmission time length, whereas a reception side device performs a reception operation at intermittent receiving intervals.

In such a transmission system, if all the transmission and reception timings of the respective devices coincide with each other, by causing the transmission side device to perform transmission processing in synchronization with a timing at which the reception side device performs the reception operation, necessary information can be transmitted and received to and from each other. As a result, construction of a system becomes remarkably simple. In addition, if all the transmission and reception timings coincide with each other, necessary information can be transmitted and received without repeatedly performing transmission and reception. As a result, current consumption required for the transmission and reception can also be reduced.

However, in many cases, a transmission processing timing and a reception processing timing of a device are determined using such an electronic part as a clock generator. Such an electronic part has a property that a clock frequency changes depending on a surrounding environment (for example, temperature). If the clock frequency changes, the transmission processing timing and the reception processing timing vary from device to device. In this manner, if there occurs a time lag between the transmission processing timing of the transmission side device and the reception processing timing of the reception side device, the reception side device cannot receive a signal.

For example, by making shorter the intermittent receiving interval of the reception side device, the probability of reception may be increased. However, there arises a problem that the current consumption increases due to the reception processing.

Further, by increasing the number of transmissions by the transmission side device, the probability of reception on the reception side may be increased. However, there arises a problem that the current consumption increases due to the transmission processing.

Further, by separately performing communication for synchronization between the reception side device and the transmission side device, the transmission timing and the reception timing may be matched. However, the current consumption increases due to communication processing for the synchronization.

If the current consumption increases as described above, the battery life of a device powered by a battery becomes shorter, which results in imposing inconvenience on a user, such as need for frequent battery replacement.

Further, wireless devices used in Japan need to meet the provisions of the Radio Law in terms of radio properties to be used. In addition, predetermined standards are set for respective intended uses (for example, standard for radio equipment for a radio station of a low power security system (standard of RCR STD-30 by the Association of Radio Industries and Businesses)). Such standards specify a time length of a transmission period, which is a period in which radio signals are allowed to be transmitted continuously, and a time length of a transmission suspension period, which is a period in which radio signals are not allowed to be transmitted. When transmission processing is performed, the transmission processing needs to be performed in compliance with those standards.

SUMMARY OF THE INVENTION

In order to solve the above-mentioned problems, the present invention has been made, and provides an alarm device that is compliant with a predetermined standard and is capable of performing transmission and reception reliably while suppressing an amount of current consumption.

An alarm device according to the present invention includes: a status detection section; a status judgment section for judging a status based on a signal output from the status detection section; a control section for causing an alarm to be output based on a result of the judging made by the status judgment section; and a transmitting/receiving section for transmitting and receiving a status signal to and from another alarm device. The transmitting/receiving section transmits the status signal to the another alarm device with a transmission pattern formed by combining transmission periods and transmission suspension periods a predetermined number of times, and receives the status signal transmitted by the another alarm device in an intermittent reception cycle. A time length of each of the transmission periods and the transmission suspension periods is set so that the another alarm device that has failed to receive the status signal transmitted in a first intermittent reception cycle can receive the status signal in a second intermittent reception cycle and subsequent intermittent reception cycles.

Further, in the alarm device as described above, a total time length of the transmission periods is set to be equal to a time length of the intermittent reception cycle.

Further, the alarm device as described above further includes an alarm section for issuing the alarm. In a case where the status signal that the transmitting/receiving section has received is an alarm signal, the control section causes the alarm section to operate.

According to the present invention, each of the alarm devices can perform transmission and reception reliably, resulting in suppression of power consumption required for the transmission and the reception.

DETAILED DESCRIPTION OF THE PREFERRED EMBODIMENTS

First Embodiment

Hereinbelow, in a first embodiment of the present invention, description is given by taking as an example a case where the present invention is applied to a fire alarm device that is powered by a battery and performs wireless communication.

Figure 1:
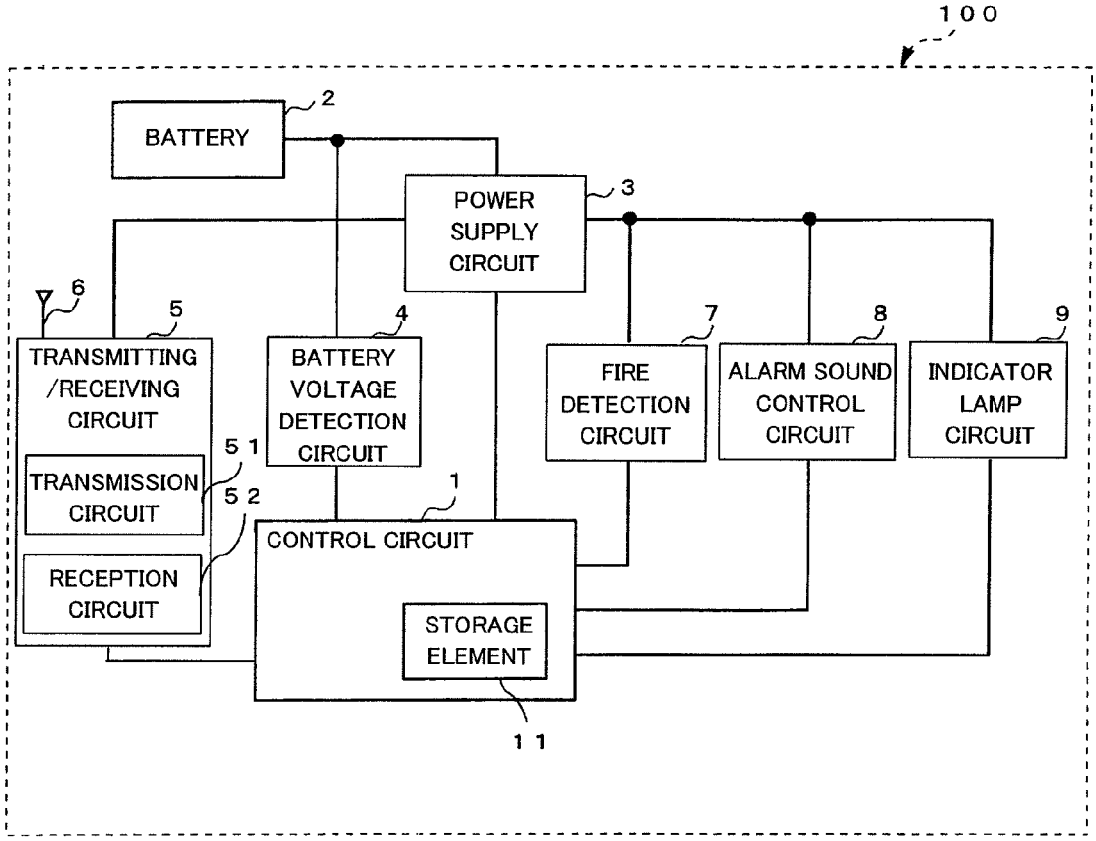
FIG. 1 is a functional block diagram of a fire alarm device according to a first embodiment of the present invention.

FIG. 1 is a functional block diagram illustrating a main configuration of a fire alarm device according to embodiments of the present invention. In FIG. 1, a fire alarm device 100 includes a control circuit 1, a battery 2, a power supply circuit 3, a battery voltage detection circuit 4, a transmitting/receiving circuit 5, an antenna 6, a fire detection circuit 7, an alarm sound control circuit 8, and an indicator lamp circuit 9.

The battery 2 supplies DC power to the power supply circuit 3. The power supply circuit 3 controls the voltage of the battery 2 to a predetermined voltage, and then supplies the predetermined voltage to the control circuit 1, the transmitting/receiving circuit 5, the fire detection circuit 7, the alarm sound control circuit 8, and the indicator lamp circuit 9.

The battery voltage detection circuit 4 detects the voltage of the battery 2 which is applied to the power supply circuit 3, and then outputs, to the control circuit 1, a battery voltage detection signal corresponding to the detected voltage. When it is detected that the level of the battery 2 has declined or fallen below a threshold for battery exhaustion, the battery voltage detection circuit 4 performs output to the control circuit 1, to thereby activate the alarm sound control circuit 8 and the indicator lamp circuit 9, and also cause the transmitting/receiving circuit 5 to output a status signal containing battery exhaustion status information.

The fire detection circuit 7 corresponds to a status detection section of the present invention. The fire detection circuit 7 detects a physical quantity or physical change of a detection subject, such as smoke or heat, which is generated by a fire phenomenon, and then outputs a signal corresponding to a detection content to the control circuit 1. The alarm sound control circuit 8 is a circuit for controlling an operation of sounding an alarm, which is performed by a buzzer, a speaker, or the like. The indicator lamp circuit 9 is a circuit for controlling an operation of turning on an indicator lamp such as an LED.

The transmitting/receiving circuit 5 is connected to the antenna 6 for transmitting and receiving radio signals, and is provided with a transmission circuit 51 and a reception circuit 52. The reception circuit 52 performs a reception sampling operation at predetermined intervals to detect a radio signal input via the antenna 6. Then, when the signal is directed to its own device, the reception circuit 52 performs reception processing. On the other hand, when the signal is not directed to its own device, the reception circuit 52 does not perform the reception processing. The signal subjected to the reception processing is output to the control circuit 1. Further, the transmission circuit 51 is controlled by the control circuit 1, and performs transmission processing for a signal such as the status signal.

The control circuit 1 has a function as a status judgment section for judging whether or not a current status is a fire status or the like based on a signal output by the fire detection circuit 7. When it is judged that the current status is the fire status, the control circuit 1 controls the alarm sound control circuit 8 and the indicator lamp circuit 9, to thereby issue an alarm by means of the sound and the indicator lamp. Further, while performing necessary processing based on a signal received by the transmitting/receiving circuit 5, the control circuit 1 controls the transmitting/receiving circuit 5 if necessary, to thereby transmit a signal such as the status signal to another fire alarm device.

A storage element 11 is a nonvolatile memory such as an EEPROM, and stores programs to be executed by the control circuit 1 and various types of data. Further, the storage element 11 also stores setting data regarding a transmission period, a transmission suspension period, and a reception sampling interval, which are described below. Based on those pieces of data, the control circuit 1 controls transmission and reception operations of the transmitting/receiving circuit 5.

If a fire occurs in an environment where the fire alarm device 100 thus configured is installed, the fire alarm device 100 detects the fire with the fire detection circuit 7, and then issues an alarm by means of the sound or the indicator lamp.

Further, in addition to an independent alarm operation, the fire alarm device 100 is also capable of such an alarm operation that is performed in synchronization with another fire alarm device 100*n*. For example, in a case where the fire alarm device 100 is installed for each room of a house, each fire alarm device 100 performs the alarm operation upon detection of a fire, and also shares information regarding the fire by transmitting, as a interlock signal, the status information regarding the fire to the another fire alarm device 100*n*.

Specifically, when any one of the fire alarm devices 100 has detected a fire, the fire alarm device 100 installed at the site of the fire performs alarm output by means of the sound or the indicator lamp. At the same time, the fire alarm device 100 uses the control circuit 1 to cause the transmitting/receiving circuit 5 to transmit the interlock signal containing an address of the fire alarm device 100 installed at the site of the fire and the status information to the another fire alarm device 100*n*, which is a synchronization target. Then, the another fire alarm device 100*n*, which is the synchronization target and has received the interlock signal, outputs a synchronized alarm by means of the sound or the indicator lamp.

On the other hand, when an alarm stop button (switch) of the another fire alarm device 100*n* serving as the synchronization target has been depressed, the another fire alarm device 100*n*, which is not installed at the site of the fire, stops a fire alarm (synchronized alarm). Further, when the alarm stop button (switch) of the fire alarm device 100 installed at the site of the fire has been depressed, the synchronized alarm of the another fire alarm device 100*n* serving as the synchronization target is stopped, and only the sounding of the fire alarm device 100 installed at the site of the fire is stopped (indicator lamp is kept ON). Further, in a case where the fire alarm device 100 has detected a fire again after self-restoration, the fire alarm device 100 performs the same operation as in the first fire detection. It should be noted that in a case where no fire is detected again, the fire alarm device 100 shifts to an operation of periodical transmission (described below).

Next, description is given of an operation of the periodical transmission performed during fire monitoring between the fire alarm device 100 serving as a master unit and the another fire alarm device 100*n* serving as a slave unit.

The periodical transmission is performed at predetermined intervals (for example, once every 15 to 20 hours).

At a predetermined transmission timing, the fire alarm device 100 serving as the master unit transmits the status signal to the another fire alarm device 100*n* serving as the slave unit. The status signal contains the status information on the fire alarm device 100 serving as the master unit or on a group constituted by the fire alarm device 100 serving as the master unit and the another fire alarm device 100*n* serving as the slave unit, and information containing an own address or a group ID for identifying a transmission source. This status signal may be repeatedly transmitted a plurality of times at predetermined time intervals. With this configuration, a probability of normal reception by the another fire alarm device 100*n* serving as the slave unit can be increased.

When the another fire alarm device 100*n* serving as the slave unit has received the status signal from the fire alarm device 100 serving as the master unit, the another fire alarm device 100*n* transmits, as the status signal, the status information regarding a device status such as the level of the battery, and the information containing the own address or the group ID for identifying the transmission source, to the fire alarm device 100 serving as the master unit.

It should be noted that when any one of the fire alarm devices 100 has detected a fire, the fire alarm device 100 shifts to the above-mentioned operation of the fire alarm.

As examples of the status information on the fire alarm device 100 serving as the master unit or on the group to which the fire alarm device 100 serving as the master unit belongs, there are enumerated a sensor status (degradation, contamination, etc.) of the fire detection circuit 7, an address or a group ID of another fire alarm device 100*n* that is suffering an abnormality and serving as the slave unit, and an address or a group ID of a slave unit for which wireless communication is not established. As examples of the status information on the slave unit, which is transmitted to the fire alarm device 100 serving as the master unit from the another fire alarm device 100*n* serving as the slave unit, there are enumerated the sensor status (degradation, contamination, etc.) of the fire detection circuit 7, and the number of times the reception processing has been performed (number of times processing for irregular radio has been performed).

In this manner, the operation of the periodical transmission in which various kinds of status information, such as the level of the battery, are transmitted to each other to check the statuses is performed at the predetermined time intervals, to thereby perform status check among the fire alarm devices.

Figure 2:
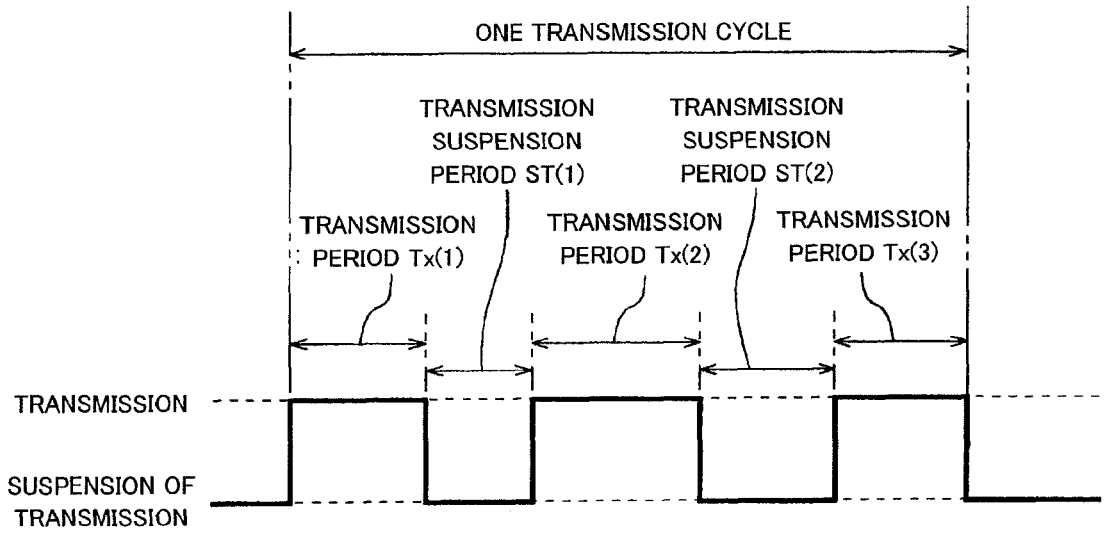
FIG. 2 is a timing chart for describing a transmission operation.
Figure 3:
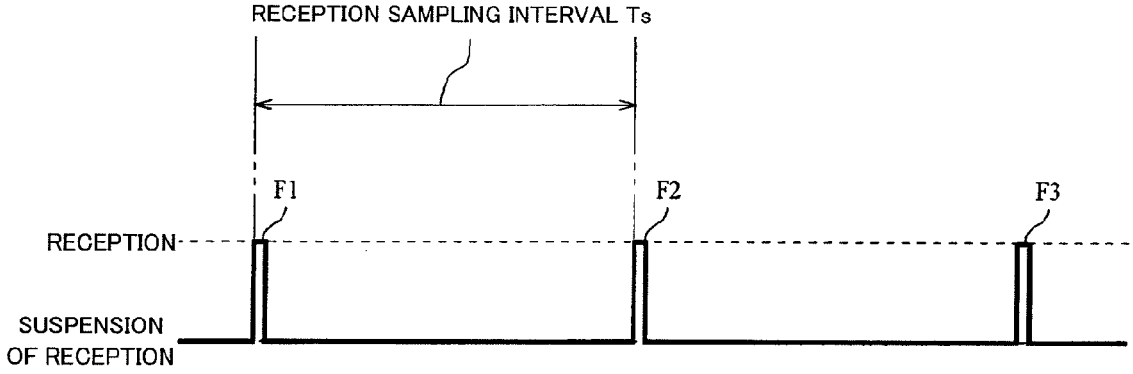
FIG. 3 is a timing chart for describing a reception operation.

Next, description is given of the transmission processing and the reception processing which are executed in the operation of transmitting and receiving the interlock signal at the time of a fire, the operation of the periodical transmission during the fire monitoring, and the like. FIG. 2 is a timing chart illustrating an operation of the transmission processing performed by the transmission circuit 51, whereas FIG. 3 is a timing chart illustrating an operation of the reception processing performed by the reception circuit 52.

(Transmission Processing)

The transmission circuit 51 forms a transmission pattern by combining transmission periods and transmission suspension periods a plurality of times. In the first embodiment of the present invention, the transmission processing is performed such that, in order to be compliant with the RCR STD-30 standard, a transmission time length is 3 seconds or shorter, and a transmission suspension time length is 2 seconds or longer. As illustrated in FIG. 2, for example, three transmission periods (i.e., n transmission periods) and two transmission suspension periods (i.e. , (n-1) transmission periods) are alternately provided in order of a transmission period Tx(1), a transmission suspension period ST(1), a transmission period Tx(2), a transmission suspension period ST(2), and a transmission period Tx(3), to thereby form one transmission cycle. In the case of transmitting the status signal or the like through the operation of transmission of the interlock signal or the periodical transmission, the transmission processing is performed for one cycle.

(Reception Processing)

The reception circuit 52 is activated at reception sampling intervals Ts to perform reception samplings F1, F2, and F3 (hereinbelow, may be collectively referred to as reception sampling Fn). Then, the reception circuit 52 checks whether or not a predetermined radio signal can be received. When the predetermined radio signal has been detected, the reception circuit 52 performs the reception processing. When no predetermined radio signal has been detected, the operation of the reception circuit 52 is stopped. In this manner, the reception circuit 52 is activated at the reception sampling intervals Ts, and is otherwise put into a suspended status, with the result that the amount of current consumption of the reception circuit 52 can be reduced remarkably.

Here, assuming that the fire alarm device 100 that transmits a radio signal is set as a transmission side alarm device 100*a*, and that the fire alarm device 100 that receives the radio signal is set as a reception side alarm device 100*b*, the reception sampling Fn needs to be included within any one of the transmission periods of the one transmission cycle so that the reception side alarm device 100*b* receives the radio signal transmitted by the transmission side alarm device 100*a*. Specifically, time lengths of the reception sampling interval Ts, the transmission periods Tx(1) to Tx(3), and the transmission suspension periods ST(1) and ST(2) need to be set in such a manner that even if the reception side alarm device 100*b* cannot receive a signal transmitted in the transmission period Tx(1), the reception side alarm device 100*b* can receive the signal reliably in any one of the transmission period Tx(2) and the transmission period Tx(3).

In the fire alarm device 100 according to the first embodiment of the present invention, for example, the following procedure is used to set the time lengths of the transmission period Tx(1), the transmission suspension period ST(1), the transmission period Tx(2), the transmission suspension period ST(2), the transmission period Tx(3), and the reception sampling interval Ts. The fire alarm device 100 is configured so as to increase the probability of normal reception by the reception side alarm device 100*b*.

Further, the fire alarm device 100 is configured so that a total time length of the transmission periods of the one transmission cycle (time length of Tx(1)+Tx(2)+Tx(3)) is equal to the reception sampling interval Ts. By forming the above-mentioned transmission pattern to perform the transmission processing, the amount of current consumption of the transmission circuit 51 can be reduced remarkably.

Figure 4:
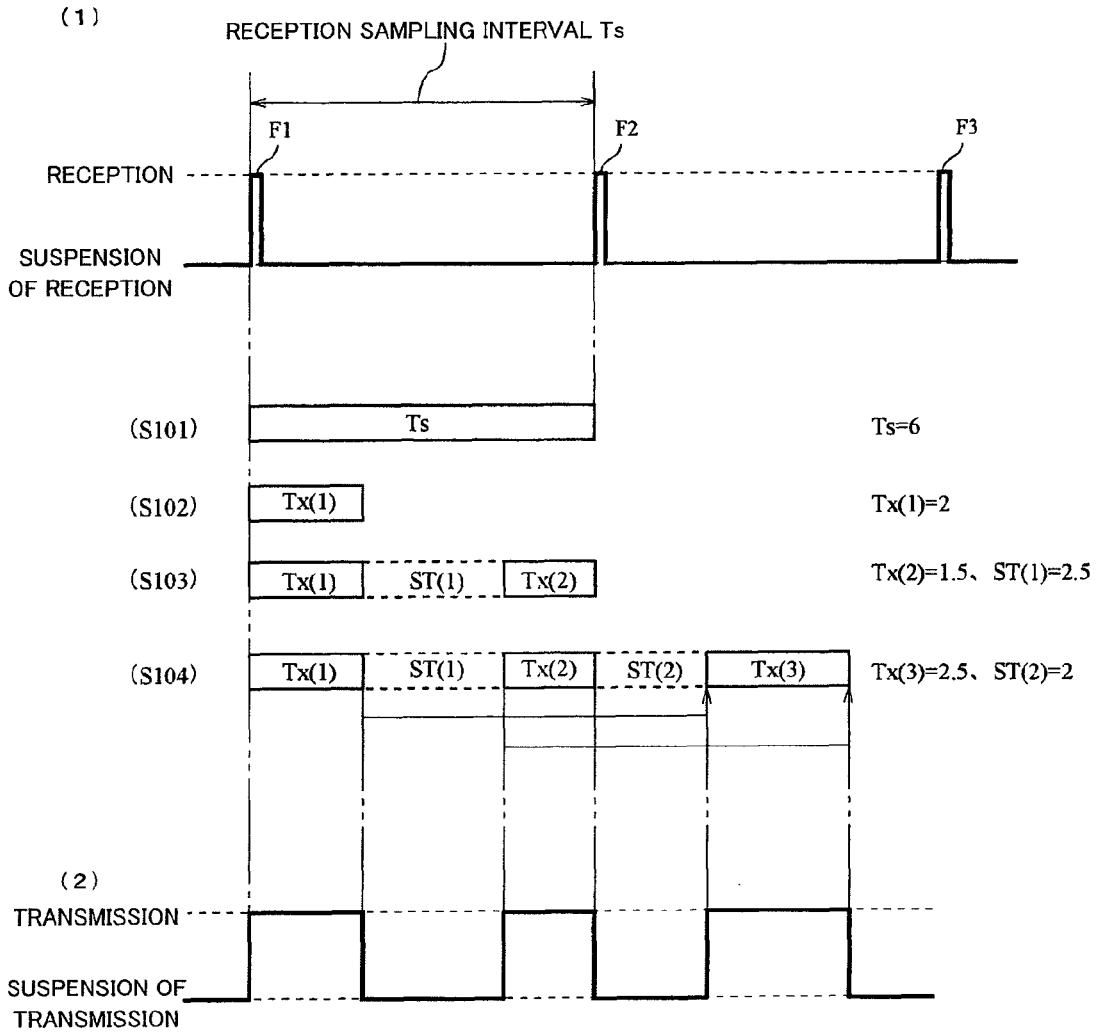
FIG. 4 is a diagram illustrating a setting procedure for time lengths of transmission periods and transmission suspension periods according to the first embodiment of the present invention.

FIG. 4 is a diagram illustrating a procedure of setting the transmission time lengths, the transmission suspension time lengths, and the reception sampling interval Ts, which is executed in the fire alarm device 100 according to the first embodiment of the present invention. Part (1) of FIG. 4 illustrates a setting procedure, whereas Part (2) of FIG. 4 is a timing chart illustrating the transmission periods and the transmission suspension periods set in Part (1) of FIG. 4.

(S101)

First, the Time Length of the Reception Sampling Interval Ts is set. From the perspective of reducing the current consumption required for the reception processing, the reception sampling interval Ts desirably has as long a time length as possible. On the other hand, in a case where the reception sampling interval Ts is too long, a delay time occurs in the reception processing, and hence the time length of the reception sampling interval Ts is appropriately set according to characteristics or the like of the alarm device. In this example, for example, the time length of the reception sampling interval Ts is set as 6 seconds.

(S102)

Next, the Time Length of the Transmission Period Tx(1) is set. On this occasion, the time length of the transmission period Tx(1) needs to be set to be equal to or shorter than a transmission time length set under a standard or the like. In a case where the transmission time length is set in compliance with the RCR STD-30 standard (hereinbelow, may be referred to as "present standard"), the time length of the transmission period Tx(1) is set to be equal to or shorter than 3 seconds. In this example, the time length of the transmission period Tx(1) is set to 2 seconds.

(S103)

Next, the Time Length of the Transmission Period Tx(2) for a Second Time transmission is set in the same manner as in the above. In this example, the time length of the transmission period Tx(2) is set to 1.5 seconds.

On this occasion, because Ts=Tx(1)+ST(1)+Tx(2), this leads to ST(1)=Ts−Tx(1)−Tx(2)=2.5, and hence the transmission suspension period ST(1) is set to 2.5 seconds. The time length of the transmission suspension period ST(1) needs to be set to be equal to or longer than a transmission suspension time length set under a standard or the like. In a case where the transmission suspension time length is set in compliance with the RCR STD-30 standard, the time length of the transmission suspension period ST(1) is set to be equal to or longer than 2 seconds. Accordingly, the condition of the present standard for the transmission suspension time length is satisfied.

(S104)

Next, the time length of the reception sampling interval Ts is added to a start time point and an end time point of the transmission suspension period ST(1), and then, a period sandwiched between time points thus obtained is set as the transmission period Tx(3). When the start time point of the transmission period Tx(1) is set to a time point of 0 seconds, the start time point of the transmission suspension period ST(1) becomes a time point of 2 seconds, and the end time point of the transmission suspension period ST(1) becomes a time point of 4.5 seconds. Accordingly, a period (from time point of 8 seconds to time point of 10.5 seconds) between time points obtained by adding the time length of the reception sampling interval Ts (6 seconds) to the respective time points is set as the transmission period Tx(3). In this example, the time length of the transmission period Tx(3) becomes 2.5 seconds, which satisfies the condition of the present standard for the transmission time length. Further, based on the fact that the total time length of the transmission periods Tx(1), Tx(2), and Tx(3) is equal to the time length of the reception sampling interval Ts, the time length of the transmission period Tx(3) can also be determined.

Then, a period sandwiched between the transmission period Tx(2) and the transmission period Tx(3) is set as the transmission suspension period ST(2). In this example, the time length of the transmission suspension period ST(2) is determined as 2 seconds from a difference between the start time point of the transmission period Tx(3) and the end time point of the transmission period Tx(2). Accordingly, the condition of the present standard for the transmission suspension time length is satisfied.

Here, in a case of transmitting the interlock signal, for example, assuming that a time length necessary for transmitting one piece of transmission data is set as 100 ms, the one piece of the transmission data is repeatedly transmitted 20 times during the transmission period Tx(1). Similarly, the one piece of the transmission data is repeatedly transmitted 15 times during the transmission period Tx(2), and 25 times during the transmission period Tx(3).

By following the above-mentioned procedure, the timing chart for the transmission processing illustrated in Part (2) of FIG. 4 can be obtained. Then, the time lengths of the transmission periods Tx(1), Tx(2), and Tx(3), the transmission suspension periods ST(1) and ST(2), and the reception sampling interval Ts are stored in the storage element 11. Based on the above-mentioned data on the time lengths stored in the storage element 11, the control circuit 1 controls the transmission circuit 51 and the reception circuit 52 to perform the transmission and reception processing. By forming the transmission pattern as illustrated in FIG. 4 to perform the transmission processing, the amount of current consumption of the transmission circuit 51 can be reduced remarkably.

Next, description is given of an operation performed when the fire alarm devices 100 thus configured perform transmission and reception among one another.

Figure 5:
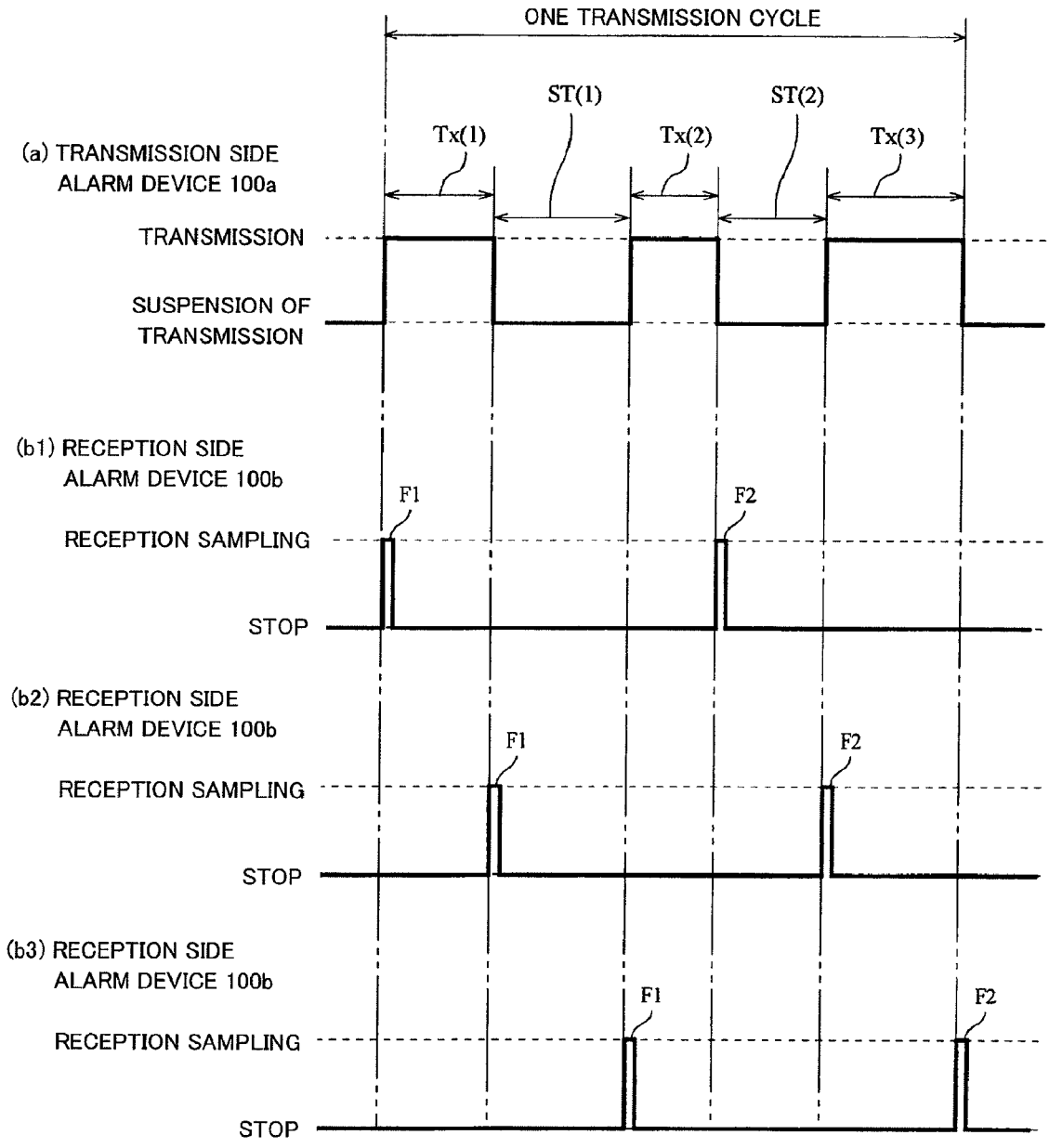
FIG. 5 is a timing chart illustrating relation between the transmission operation and the reception operation according to the first embodiment of the present invention.

FIG. 5 is a timing chart illustrating the transmission operation and the reception operation to be performed by the transmission side alarm device 100*a* and the reception side alarm device 100*b*, respectively.

Part (a) of FIG. 5 illustrates the transmission operation of the transmission side alarm device 100*a*, whereas Parts (b1) to (b3) of FIG. 5 illustrate the reception operation of the reception side alarm device 100*b*. Parts (b1) to (b3) of FIG. 5 illustrate typical examples of cases where the reception sampling Fn is performed at different timings. In each of the cases, the reception sampling interval Ts is the same.

As illustrated in Part (a) of FIG. 5, the transmission side alarm device 100*a* performs transmission of the status signal or the like according to the transmission periods and the transmission suspension periods set in FIG. 4.

With regard to the reception side alarm device 100*b* illustrated in Part (b1) of FIG. 5, a timing at which the reception sampling F1 is performed is included in the transmission period Tx(1). Accordingly, the reception side alarm device 100*b* can receive the signal transmitted in the transmission period Tx(1).

With regard to the reception side alarm device 100*b* illustrated in Part (b2) of FIG. 5, the timing at which the reception sampling F1 is performed is included in the transmission suspension period ST(1). Accordingly, the reception side alarm device 100*b* cannot receive the transmitted signal with the reception sampling F1. However, a timing at which the next reception sampling F2 is performed is included in the transmission period Tx(3). Accordingly, the reception side alarm device 100*b* can receive the signal transmitted in the transmission period Tx(3).

With regard to the reception side alarm device 100*b* illustrated in Part (b3) of FIG. 5, the timing at which the reception sampling F1 is performed is included in the transmission period Tx(2). Accordingly, the reception side alarm device 100*b* can receive the signal transmitted in the transmission period Tx(2).

In the examples illustrated in FIG. 5, the reception side alarm device 100*b* can perform the reception processing with any one of the reception sampling F1 and the reception sampling F2. Specifically, a difference between a reception processing timing of the reception side alarm device 100*b* that has performed the first reception processing and a reception processing timing of the reception side alarm device 100*b* that has performed the last reception processing is less than twice the time length of the reception sampling interval Ts at the maximum. Therefore, it is possible to prevent the delay time of the reception processing among the reception side alarm devices 100*b* from increasing.

Here, in the first embodiment of the present invention, the description has been given by taking as an example the case where the reception sampling interval Ts is 6 seconds. This reception sampling interval Ts is determined based on relation between the number of transmission periods in the one transmission cycle and the amount of current consumption.

Specifically, when the reception sampling interval Ts is made longer, the number of reception samplings performed per unit time decreases, and hence the amount of current consumption required for the reception sampling processing per unit time can be reduced. On the other hand, the transmission side alarm device 100*a* needs to increase the total time length of transmission periods in the one transmission cycle so that the reception side alarm device 100*b* can receive the signal reliably. Thus, the amount of current consumption required for the transmission processing inevitably increases.

In view of this, the reception sampling interval Ts and the total time length of the transmission periods in the one transmission cycle need to be set in a manner that the amounts of current consumption required for the reception sampling processing and for the transmission processing are best balanced.

Figure 6:
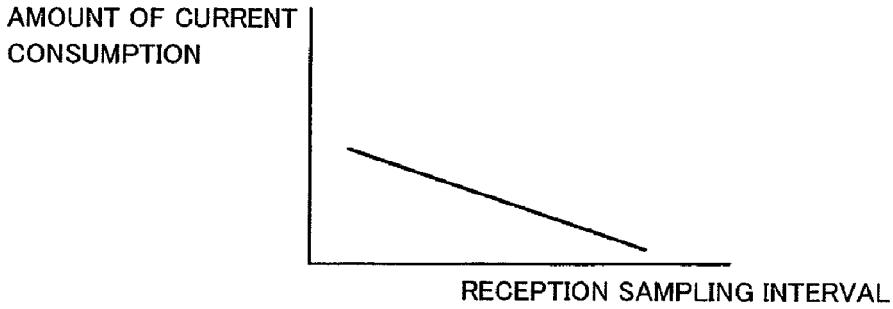
FIGS. 6A, 6B, and 6C are graphs each illustrating relation between a reception sampling interval and an amount of current consumption.
Figure 6:
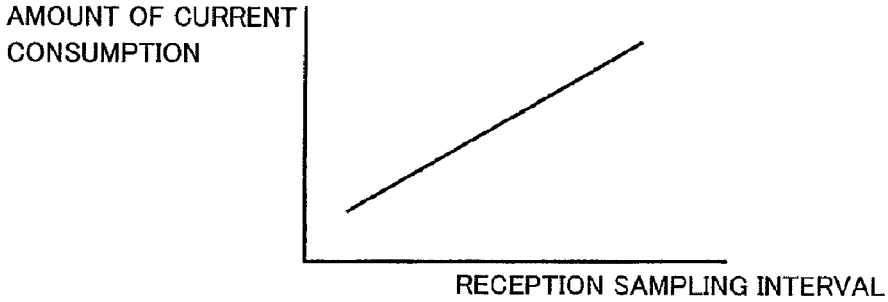
Figure 6:
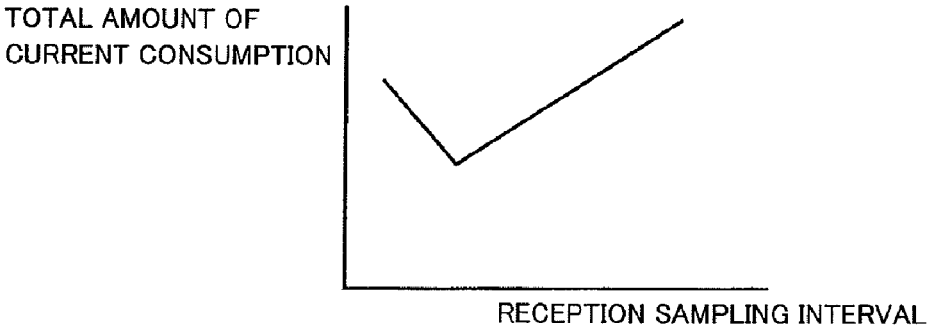

FIGS. 6A, 6B, and 6C are graphs each illustrating an example of the relation between the reception sampling interval Ts and the amount of current consumption. FIG. 6A is a graph illustrating the amount of current consumption required for the reception sampling. FIG. 6B is a graph illustrating the amount of current consumption required for the transmission processing. FIG. 6C is a graph illustrating a typical pattern of a total amount of current consumption obtained by combining the amounts of current consumption of FIGS. 6A and 6B. In each of the graphs, the ordinate represents the amount of current consumption while the abscissa represents the reception sampling interval Ts.

As illustrated in FIG. 6A, as the reception sampling interval Ts increases, the number of reception samplings performed per unit time decreases, which results in decrease in amount of current consumption per unit time.

On the other hand, as illustrated in FIG. 6B, as the reception sampling interval Ts increases, the total time length of the transmission periods in the one transmission cycle needs to be increased, which results in increase in amount of current consumption required for the transmission processing per unit time.

FIG. 6C is a graph illustrating the sum of the amounts of current consumption of FIG. 6A and FIG. 6B, in which the total amount of current consumption shifts from a decreasing trend to an increasing trend with a predetermined value being a threshold. Thus, by referring to FIG. 6C, the reception sampling interval Ts can be set so that the total amount of current consumption becomes the smallest.

As described above, with the fire alarm device 100 according to the first embodiment of the present invention, even if the status signal transmitted in the transmission period Tx(1) for a first time transmission fails to be received, the status signal transmitted in the transmission period Tx(2) for a second time transmission or the transmission period Tx(3) for a third time transmission can be received. Therefore, by performing the transmission for one cycle, the transmission side alarm device 100*a* enables the reception side alarm device 100*b* to receive the signal reliably. For this reason, even if a time lag occurs in the timing of the reception sampling due to change in installation environment of the fire alarm device 100, the status signal can be received reliably. Further, there is no need to separately perform communication for synchronizing the transmission and reception timings with each other, which therefore prevents the amount of current consumption from increasing due to the communication processing for the synchronization.

Further, because the setting is made such that the total time length of the transmission periods in the one transmission cycle is equal to the reception sampling interval Ts, the reception side alarm device 100*b* can perform the reception processing efficiently and reliably in the one transmission cycle. In addition, regardless of the number of transmission periods in the one transmission cycle, the total time length of the transmission periods is constant, and hence the amount of current consumption required for the transmission processing can be reduced remarkably.

Here, in the first embodiment of the present invention, the description has been given by taking as an example the case where the total time length of the transmission periods in the one transmission cycle is set to be equal to the reception sampling interval Ts. However, even in a case where the reception sampling interval Ts is longer than the total time length of the transmission periods in the one transmission cycle, by setting the transmission period, the transmission suspension period, and the reception sampling interval Ts to predetermined time lengths, respectively, it becomes possible to obtain the fire alarm device 100 that enables the reception side alarm device 100*b* to receive a signal reliably through transmission for one cycle by the transmission side alarm device 100*a*.

Further, the transmission time length and the transmission suspension time length of the first embodiment of the present invention are set according to the following rule. That is, the reception sampling interval Ts is divided into three time areas in a manner that each of the three time areas is equal to or longer than the transmission suspension period and is shorter than the transmission period, the transmission suspension period and the transmission period being set under the present standard. The respective areas are set as the transmission period (Tx(1)), the transmission suspension period (ST(1)), and the transmission period (Tx(2)) in the stated order. After that, the transmission period and the transmission suspension period are reversed to each other by using the same division intervals, and then the reversed periods are set as the transmission suspension period (ST(2)) and the transmission period (Tx(3)), respectively. However, the setting method for the transmission period and the transmission suspension period described in the first embodiment of the present invention is merely an example, and the present invention is not limited thereto. The same applies to the following description.

Second Embodiment

In a second embodiment of the present invention, description is given of another example of the transmission time length, the transmission suspension time length, and the reception sampling interval Ts.

Figure 7:
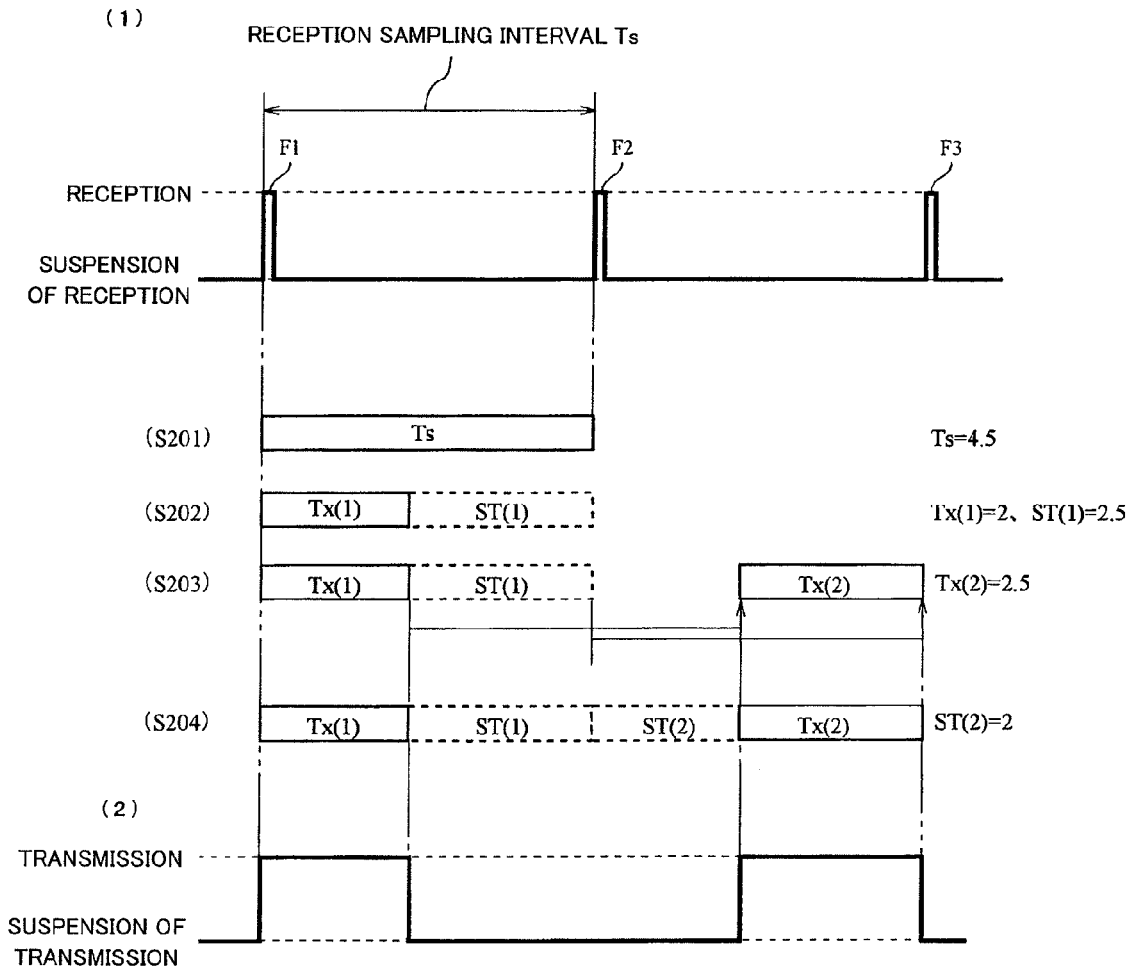
FIG. 7 is a diagram illustrating a setting procedure for time lengths of transmission periods and transmission suspension periods according to a second embodiment of the present invention.

FIG. 7 is a diagram illustrating a procedure of setting the transmission time lengths, the transmission suspension time lengths, and the reception sampling interval Ts, which is executed in a fire alarm device 100 according to the second embodiment of the present invention. Part (1) of FIG. 7 illustrates a setting procedure, whereas Part (2) of FIG. 7 is a timing chart illustrating the transmission periods and the transmission suspension periods set in Part (1) of FIG. 7.

In the second embodiment of the present invention, the number of transmission periods in one transmission cycle is two.

(S201)

First, the Time Length of the Reception Sampling Interval Ts is set. In this example, the time length of the reception sampling interval Ts is set as 4.5 seconds.

(S202)

Next, the Time Length of the Transmission Period Tx(1) is set. On this occasion, the transmission period Tx(1) is set to have a transmission time length (equal to or shorter than 3 seconds) set under the present standard. In this example, the time length of the transmission period Tx(1) is set to 2 seconds. Then, a period from the end of the transmission period Tx(1) to the end of the reception sampling interval Ts is set as the transmission suspension period ST(1). In this example, the time length of the transmission suspension period ST(1) becomes 2.5 seconds, which satisfies a condition of the present standard for the transmission suspension time length (equal to or longer than 2 seconds).

(S203)

Next, the Time Length of the Reception Sampling Interval Ts is Added to the start time point and the end time point of the transmission suspension period ST(1), and then a period sandwiched between time points thus obtained is set as the transmission period Tx(2). On this occasion, the transmission period Tx(2) is set to satisfy Tx(2)>ST(1) so that the transmission period Tx(2) has a transmission time length (equal to or shorter than 3 seconds) determined under the standard and is equal to or longer than half the length of the reception sampling interval Ts. In this example, the transmission period Tx(2) becomes 2.5 seconds, which satisfies the condition of the present standard for the transmission time length.

(S204)

Next, a Period from the End of the Transmission Suspension Period ST(1) to the start of the transmission period Tx(2) is set as the transmission suspension period ST(2). It should be noted that the time length of ST(1)$_+$ST(2) is set to a transmission suspension period (equal to or longer than 2 seconds) determined under the present standard. In this example, the time length of the transmission suspension period ST(2) becomes 2 seconds, which satisfies the condition of the present standard for the transmission suspension period.

By following the above-mentioned procedure, the timing chart for the transmission processing illustrated in Part (2) of FIG. 7 can be obtained. Then, the time lengths of the transmission periods Tx(1) and Tx(2), the transmission suspension periods ST(1) and ST(2), and the reception sampling interval Ts are stored in the storage element 11. Based on the above-mentioned data on the time lengths stored in the storage element 11, the control circuit 1 controls the transmission circuit 51 and the reception circuit 52 to perform the transmission and reception processing.

Next, description is given of an operation performed when the fire alarm devices 100 thus configured perform transmission and reception among one another.

Figure 8:
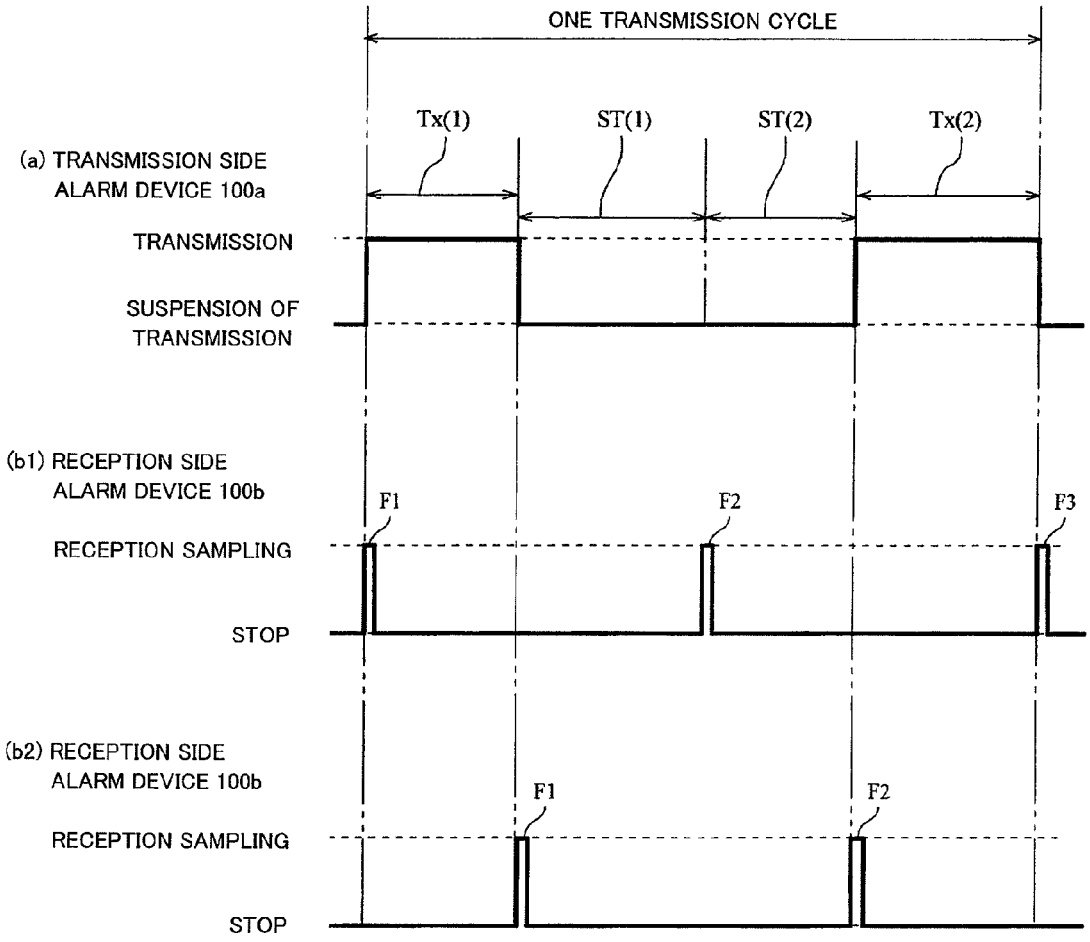
FIG. 8 is a timing chart illustrating relation between the transmission operation and the reception operation according to the second embodiment of the present invention.

FIG. 8 is a timing chart illustrating the transmission operation and the reception operation to be performed by the transmission side alarm device 100*a* and the reception side alarm device 100*b*, respectively.

Part (a) of FIG. 8 illustrates the transmission operation of the transmission side alarm device 100*a*, whereas Parts (b1) and (b2) of FIG. 8 illustrate the reception operation of the reception side alarm device 100*b*. Parts (b1) and (b2) of FIG. 8 illustrate typical examples of cases where the reception sampling Fn is performed at different timings. In each of the cases, the reception sampling interval Ts is the same.

As illustrated in Part (a) of FIG. 8, the transmission side alarm device 100*a* performs transmission of the status signal or the like according to the transmission periods and the transmission suspension periods set in FIG. 7.

With regard to the reception side alarm device 100*b* illustrated in Part (b1) of FIG. 8, the timing at which the reception sampling F1 is performed is included in the transmission period Tx(1). Accordingly, the reception side alarm device 100*b* can receive the signal transmitted in the transmission period Tx(1).

With regard to the reception side alarm device 100*b* illustrated in Part (b2) of FIG. 8, the timing at which the reception sampling F1 is performed is included in the transmission suspension period ST(1). Accordingly, the reception side alarm device 100*b* cannot receive the transmitted signal with the reception sampling F1. However, a timing at which the next reception sampling F2 is performed is included in the transmission period Tx(2). Accordingly, the reception side alarm device 100*b* can receive the signal transmitted in the transmission period Tx(2).

As described above, with the fire alarm device 100 according to the second embodiment of the present invention, even if the status signal transmitted in the transmission period Tx(1) for a first time transmission fails to be received, the status signal transmitted in the transmission period Tx(2) for a second time transmission can be received. Therefore, by performing the transmission for one cycle, the transmission side alarm device 100*a* enables the reception side alarm device 100*b* to receive the signal reliably. For this reason, even if a time lag occurs in the timing of the reception sampling, the status signal can be received reliably. Further, there is no need to separately perform communication for synchronizing the transmission and reception timings with each other, which therefore prevents the amount of current consumption from increasing due to the communication processing for the synchronization.

Hence, the same effect as in the first embodiment described above can be obtained as well.

Third Embodiment

In a third embodiment of the present invention, description is given of a further example of the transmission time length, the transmission suspension time length, and the reception sampling interval Ts.

Figure 9:
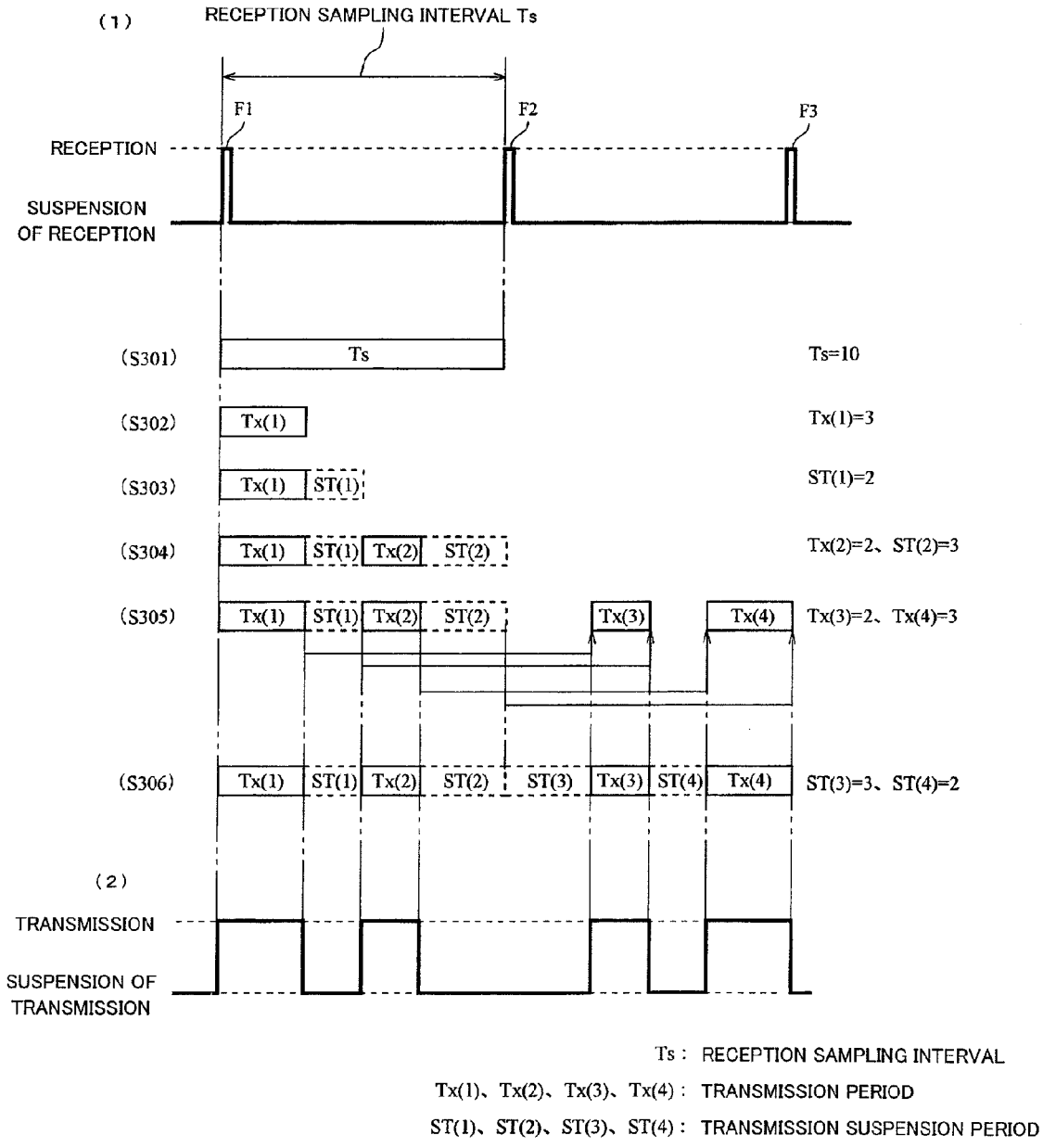
FIG. 9 is a diagram illustrating a setting procedure for time lengths of transmission periods and transmission suspension periods according to a third embodiment of the present invention.

FIG. 9 is a diagram illustrating a procedure of setting the transmission time lengths, the transmission suspension time lengths, and the reception sampling interval Ts, which is executed in a fire alarm device 100 according to the third embodiment of the present invention. Part (1) of FIG. 9 illustrates a setting procedure, whereas Part (2) of FIG. 9 is a timing chart illustrating the transmission periods and the transmission suspension periods set in Part (1) of FIG. 9.

In the third embodiment of the present invention, the number of transmission periods in one transmission cycle is four.

(S301)

First, the Time Length of the Reception Sampling Interval Ts is set. In this example, the time length of the reception sampling interval Ts is set as 10 seconds.

(S302)

Next, the Time Length of the Transmission Period Tx(1) is set. On this occasion, the transmission period Tx(1) is set to have a transmission time length (equal to or shorter than 3 seconds) set under the present standard. In this example, the time length of the transmission period Tx(1) is set to 3 seconds.

(S303)

Next, the Time Length of the Transmission Suspension Period ST(1) for a first time transmission is set. On this occasion, the transmission suspension period ST(1) for a first time transmission is set to have a transmission suspension time length (equal to or longer than 2 seconds) set under a standard or the like. In this example, the time length of the transmission suspension period ST(1) is set to 2 seconds.

(S304)

Next, by Following the Same Procedure as in Steps S302 and S303, the time length of the transmission period Tx(2) for a second time transmission and the time length of the transmission suspension period ST(2) for a second time transmission are set. In this example, the time length of the transmission period Tx(2) is set to 2 seconds, and the time length of the transmission suspension period ST(2) is set to 3 seconds.

On this occasion, the setting is made so that the time length of Tx(1)+ST(1)+Tx(2)+ST(2) is equal to the reception sampling interval Ts.

(S305)

Then, the Time Length of the Reception Sampling Interval Ts is Added to the start time point and the end time point of the transmission suspension period ST(1), and a period sandwiched between time points thus obtained is set as the transmission period Tx(3). Assuming that the start time point of the transmission period Tx(1) is at a time point of 0 seconds, the start time point of the transmission suspension period ST(1) becomes a time point of 3 seconds, and the end time point of the transmission suspension period ST(1) becomes a time point of 5 seconds. Accordingly, by adding the time length of the reception sampling interval Ts (10 seconds) to the respective time points, a period between a time point of 13 seconds and a time point of 15 seconds corresponds to the transmission period Tx(3). In this example, the time length of the transmission period Tx(3) becomes 2 seconds, which satisfies a condition of the present standard for the transmission time length.

Further, by adding the time length of the reception sampling interval Ts to the start time point and the end time point of the transmission suspension period ST(2), a period sandwiched between time points thus obtained is set as a transmission period Tx(4). Assuming that the start time point of the transmission period Tx(1) is at a time point of 0 seconds, the start time point of the transmission suspension period ST(2) becomes a time point of 7 seconds and the end time point of the transmission suspension period ST(2) becomes a time point of 10 seconds. Accordingly, by adding the time length of the reception sampling interval Ts (10 seconds), a period between a time point of 17 seconds and a time point of 20 seconds corresponds to the transmission period Tx(4). In this example, the time length of the transmission period Tx(4) is 3 seconds, which satisfies the condition of the present standard for the transmission time length.

(S306)

Then, a Period Sandwiched Between the Transmission Suspension Period ST(2) and the transmission period Tx(3) is set as a transmission suspension period ST(3). A period sandwiched between the transmission period Tx(3) and the transmission period Tx(4) is set as a transmission suspension period ST(4). In this example, the time length of the transmission suspension period ST(3) is 3 seconds, and the time length of the transmission suspension period ST(4) is 2 seconds.

By following the above-mentioned procedure, the timing chart for the transmission processing illustrated in Part (2) of FIG. 9 can be obtained. Then, the time lengths of the transmission periods Tx(1), Tx(2), Tx(3), and Tx(4), the transmission suspension periods ST(1), ST(2), ST(3), and ST(4), and the reception sampling interval Ts are stored in the storage element 11. Based on the above-mentioned data on the time lengths stored in the storage element 11, the control circuit 1 controls the transmission circuit 51 and the reception circuit 52 to perform the transmission and reception processing.

Next, description is given of an operation performed when the fire alarm devices 100 thus configured perform transmission and reception among one another.

Figure 10:
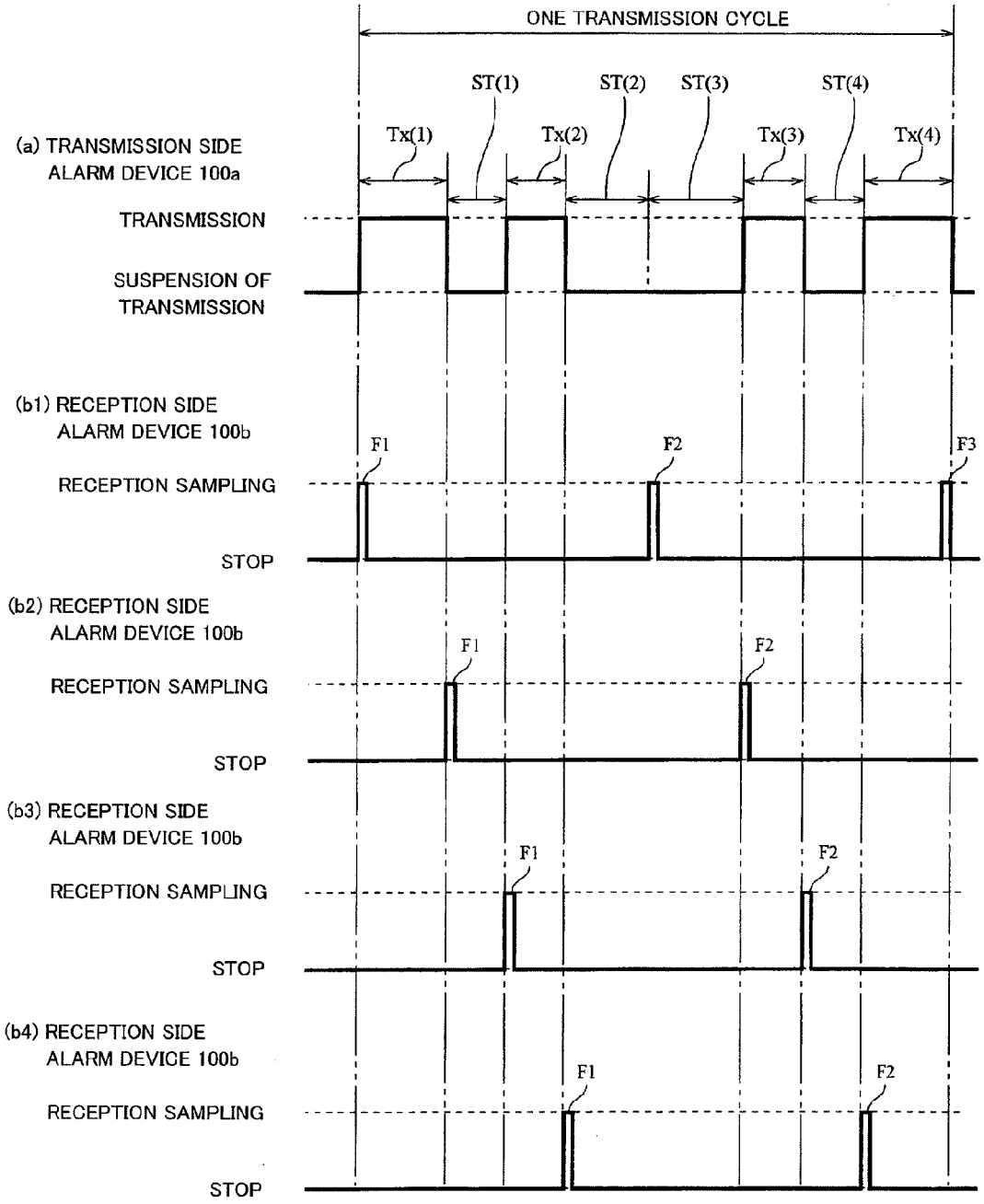
FIG. 10 is a timing chart illustrating relation between the transmission operation and the reception operation according to the third embodiment of the present invention.

FIG. 10 is a timing chart illustrating the transmission operation and the reception operation to be performed by the transmission side alarm device 100*a* and the reception side alarm device 100*b*, respectively.

Part (a) of FIG. 10 illustrates the transmission operation of the transmission side alarm device 100*a*, whereas Parts (b1) to (b4) of FIG. 10 illustrate the reception operation of the reception side alarm device 100*b*. Parts (b1) to (b4) of FIG. 10 illustrate typical examples of cases where the reception sampling Fn is performed at different timings. In each of the cases, the reception sampling interval Ts is the same.

As illustrated in Part (a) of FIG. 10, the transmission side alarm device 100*a* performs transmission of the status signal or the like according to the transmission periods and the transmission suspension periods set in FIG. 9.

With regard to the reception side alarm device 100*b* illustrated in Part (b1) of FIG. 10, the timing at which the reception sampling F1 is performed is included in the transmission period Tx(1). In this case, the reception side alarm device 100*b* can receive the signal transmitted in the transmission period Tx(1).

With regard to the reception side alarm device 100*b* illustrated in Part (b2) of FIG. 10, the timing at which the reception sampling F1 is performed is included in the transmission suspension period ST(1). Accordingly, the reception side alarm device 100*b* cannot receive the signal with the reception sampling F1. However, the timing at which the next reception sampling F2 is performed is included in the transmission period Tx(3). Accordingly, the reception side alarm device 100*b* can receive the signal transmitted in the transmission period Tx(3).

With regard to the reception side alarm device 100*b* illustrated in Part (b3) of FIG. 10, the timing at which the reception sampling F1 is performed is included in the transmission period Tx(2). In this case, the reception side alarm device 100*b* can receive the signal transmitted in the transmission period Tx(2).

With regard to the reception side alarm device 100*b* illustrated in Part (b4) of FIG. 10, the timing at which the reception sampling F1 is performed is included in the transmission suspension period ST(2). Accordingly, the reception side alarm device 100*b* cannot receive the signal with the reception sampling F1. However, the timing at which the next reception sampling F2 is performed is included in the transmission period Tx(4). Accordingly, the reception side alarm device 100*b* can receive the signal transmitted in the transmission period Tx(4).

As described above, with the fire alarm device 100 according to the third embodiment of the present invention, even if the status signal transmitted in the transmission period Tx(1) for a first time transmission fails to be received, the status signal transmitted in the transmission period Tx(2) for a second time transmission, the transmission period Tx(3) for a third time transmission, or the transmission period Tx(4) for a fourth time transmission can be received. Therefore, by performing the transmission for one cycle, the transmission side alarm device 100*a* enables the reception side alarm device 100*b* to receive the signal reliably. For this reason, even if a time lag occurs in the timing of the reception sampling, the status signal can be received reliably. Further, there is no need to separately perform communication for synchronizing the transmission and reception timings with each other, which therefore prevents the amount of current consumption from increasing due to the communication processing for the synchronization.

Hence, the same effect as in the first embodiment described above can be obtained as well.

In the first to third embodiments described above, there have been given the examples in which the transmission period and the transmission suspension period are set so that the reception side alarm device 100*b* can complete the reception processing by using any one of the reception samplings F1 and F2. Specifically, there have been given comprehensible examples in which, by setting a transmission pattern (transmission periods and transmission suspension periods) in a first reception sampling interval Ts, and a transmission pattern obtained through reversing the first transmission pattern in a second reception sampling interval Ts, any one of the reception samplings F1 and F2 is included in the transmission periods (Tx(1) to Tx(4)) of the transmission side alarm device 100*a*, thereby enabling the reception side alarm device 100*b* to complete the reception processing.

However, it is not necessarily required that the transmission patterns be set so that the reception processing is completed with two or less reception samplings (reception sampling F1 or F2). For example, the time lengths of the transmission periods and the transmission suspension periods may be set so that the reception processing is completed with a reception sampling F3 or subsequent reception samplings. On this occasion, the transmission pattern of the second reception sampling interval Ts does not need to have reverse relation with the transmission pattern of the first reception sampling interval Ts.

Here, in the above description, the description has been given by taking as an example the case where the present invention is applied to the fire alarm device that is powered by the battery and performs wireless communication, but the present invention does not limit a power supply method or a communication method of the fire alarm device. Further, apart from the fire alarm device, the present invention is also applicable to an alarm device for abnormality detection or the like. Further, the present invention may also be employed to a receiver and a detector of an automatic fire alarm system.

What is claimed is:

1. An alarm device, comprising:

a status detection section;

a status judgment section for judging a status based on a signal output from the status detection section;

a control section for causing an alarm to be output based on a result of the judging made by the status judgment section; and a transmitting/receiving section for transmitting and receiving a status signal to and from another alarm device, wherein:

the transmitting/receiving section transmits the status signal to the another alarm device with a transmission pattern formed by combining n transmission periods, where n is a number greater than or equal to 2, and (n-1) transmission suspension periods alternately between the n transmission periods, and receives the status signal transmitted by the another alarm device in an intermittent constant reception cycle;

the n transmission periods are set as having at least two or more types of different time lengths; and a time length of each of the transmission periods and the transmission suspension periods is set so that the another alarm device that has failed to receive the status signal transmitted in a first intermittent reception cycle can receive the status signal transmitted in a second intermittent reception cycle and subsequent intermittent reception cycles.

2. An alarm device according to claim 1, wherein a total time length of the n transmission periods is set to be equal to a time length of the intermittent constant reception cycle.

* * * * *